United States Patent [19]

Malaker et al.

[11] Patent Number: 4,912,932

[45] Date of Patent: Apr. 3, 1990

[54] UNLOADER VALVE FOR CRYOGENIC REFRIGERATOR

[75] Inventors: Stephen F. Malaker, Mountainside; Chester B. Pawelski, South Somerville, both of N.J.

[73] Assignee: Cryodynamics, Inc., Mountainside, N.J.

[21] Appl. No.: 96,721

[22] Filed: Sep. 14, 1987

[51] Int. Cl.[4] ..... F25B 9/00

[52] U.S. Cl. ..... 62/6; 62/196.1

[58] Field of Search ..... 62/196.1, 6

[56] References Cited

U.S. PATENT DOCUMENTS

| | | | |
|---|---|---|---|
| 3,321,926 | 5/1967 | Chellis | 62/6 |
| 3,466,867 | 9/1969 | Brandes | 62/6 |
| 3,550,371 | 12/1970 | Jaspers | 62/6 |
| 3,698,182 | 10/1972 | Knoos | 62/6 |
| 3,834,172 | 9/1974 | Dehne | 62/6 |
| 4,335,582 | 6/1982 | Shaw et al. | 62/196.1 |
| 4,417,448 | 11/1983 | Horn et al. | 62/6 |
| 4,524,586 | 6/1985 | Jensen | 62/6 |

*Primary Examiner*—Ronald C. Capossela
*Attorney, Agent, or Firm*—Kevin McMahon

[57] ABSTRACT

A modified Stirling cycle cryogenic refrigerator having an improved unloader valve mechanism for bypassing the compressor cylinder for a short time during start-up in order to reduce the starting torque on the motor driving the pistons and when the drive motor is turned off in order to prevent the refrigerator from spontaneously running in reverse.

9 Claims, 2 Drawing Sheets

UNLOADER VALVE FOR CRYOGENIC REFRIGERATOR

FIELD OF INVENTION

This invention relates generally to relief valves for cryogenic refrigerators and more particularly to compressor piston bypass valves for cryogenic refrigerators.

BACKGROUND

Modified Stirling cycle cryogenic refrigerators of the type described in the U.S. Pat. No. 3,074,244 have proved to have substantial advantages over other known types of refrigeration systems. Such refrigerators are inherently lighter, less expensive, more reliable and more efficient than any other available system. Additional important advantages are that they operate using non hazardous working gases, such as helium or nitrogen and require no condenser or evaporator coils.

Such modified Stirling cycle refrigerators are frequently driven by an electrical motor. A problem that has been experienced particularly with large size refrigerators of this type is that when the refrigerator is turned off by removing power from the electrical motor, the temperatures difference between the cold head and the body of the refrigerator can cause the refrigerator to run spontaneously in reverse as an engine, thus tending to warm the cold head. This resulted in substantial reductions in the refrigerator's efficiency since it was essentially working against itself.

A further problem existed in that the starting torque of the refrigerator caused the electrical motor to experience a large starting current surge and the motor and winding had to be large enough to support it. This increased the cost of the system.

To overcome those problems a bypass channel and a solenoid controlled bypass valve, also referred to as an unloader valve, have been incorporated into some refrigerators. When the unloader valve is open, the channel bypasses the compressor piston so that the pressure build-up in the compression cylinder during the compression cycle is minimized. In this system the unloader valve is actuated to the closed position by the solenoid after a time delay each time the electric motor is turned on during operation of the refrigerator, and is held closed by the solenoid for as long as the refrigerator operated. The unloader valve is opened when the electric motor is turned off. The bypassing of the compressor piston by opening the unloader valve both reduced the starting torque and prevented the refrigerator from running in reverse when the power was removed.

A problem still existed however in that the solenoid had to be operated continuously while the refrigerator was operating, which caused a heat buildup within the refrigerator that had to be dissipated and which decreased the efficiency of the system.

SUMMARY OF THE INVENTION

In accordance with the invention there is provided an improved closed cycle Stirling cycle refrigerator having a piston driven by an electrical motor for cyclically compressing a working gas in a compressor cylinder which includes channel means for bypassing the compressor piston and a valve for blocking the channel means when closed so as to permit the normal operation of the refrigerator. Means are provided for closing the valve and for passively retaining the valve in the closed position. Also included are control means operable each time the electrical motor is turned on or off for opening the valve means for a time sufficient to reduce the starting torque on the motor when the motor is turned on and for preventing the refrigerator from running spontaneously in reverse when the motor is turned off.

These and other advantages and features of the invention will become more fully apparent from the following detailed description of the preferred embodiment of the invention as illustrated in the accompanying drawings.

DESCRIPTION OF PREFERRED EMBODIMENT

Figure 1:
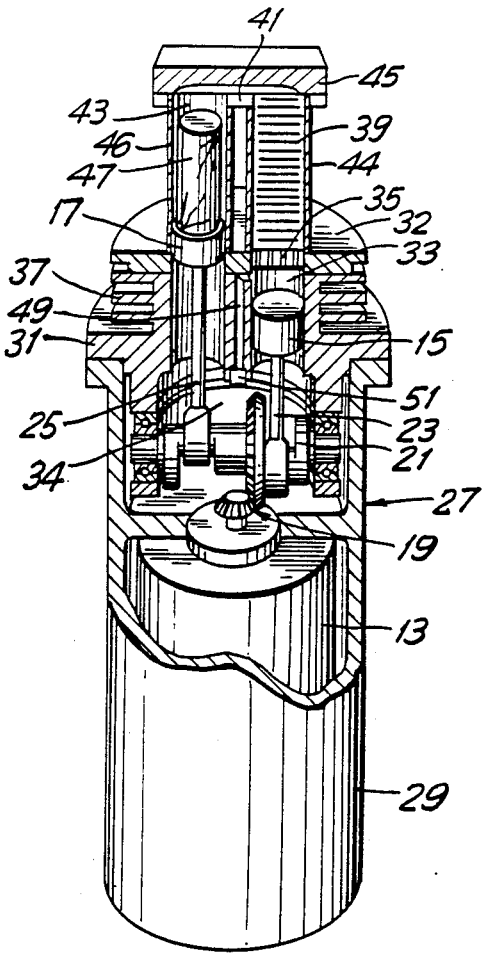
FIG. 1 is a cutaway isometric view of a modified Stirling cycle cryogenic refrigerator incorporating the improved unloader valve in accordance with the invention.

The cryogenic refrigerator of the present invention constitutes an improvement in the closed cycle modified Stirling cycle refrigerator described in the U.S. Pat. No. 3,074,244 and operates in the same basic manner as is described in that patent. Referring to the embodiment of the invention illustrated in FIG. 1 of the drawings, the illustrated embodiment of the cryogenic refrigerator 11 is driven by an electrical motor 13 which drives the compressor piston 15 and the expander piston 17 through a bevel gear 19, a drive shaft 21 and the compressor and expander piston rod 23 and 25, respectively. The refrigerator 11 is encased in an hermetically sealed case 27 made up of a lower portion 29, an upper portion 31 and a cylinder head 32. The interior of the refrigerator 11 is filled with a working gas which is preferably helium.

As is more completely described in the above referred to U.S. Pat. No. 3,074,244, the working gas is isothermally compressed in the compression cylinder 33 by the compressor piston 15 with the heat of compression being dissipated through the heat exchanger 35 and the cooling fins 37. The compressed working gas is then transferred at a constant volume through the regenerator 39 and the channel 41 to the expander cylinder 43 where it is isothermally expanded by the expander piston 17. During the expansion heat is extracted from the cold head 45. The gas is then transferred at constant volume back through the channel 41, regenerator 39 and the heat exchange 35 to the compressor cylinder 33 where the cycle begins again.

The casings 44 and 46 of the regenerator 39 and the expander cylinder 43, respectively, are formed by thin walled metal tubes, which may be fabricated, for instance, of stainless steel. The tubes 44 and 46 are secured to the upper section 31 of the case 27 by the cylinder head 32 and to the lower surface of the cold head 45 by a flange (not shown) so as to prevent any leakage of the working gas.

The cold head 45 is progressively cooled on each cycle until it reaches cryogenic temperatures. Cryogenic refrigerators operating in the above described manner easily reach temperatures of 77° K. at the cold head and have been operated at temperatures below 30° K. The expander piston 17 is protected from exposure to the extremely cold working gas in the expander cylinder 43 by the extension 47 which may, for instance, be made of an insulating materials such as wood.

When the electric motor 13 is first turned on, the initial compression of the helium working gas in the compressor cylinder 33 can cause a substantial starting torque on the motor 13 which results in a large current surge in the motor 13. To accommodate such a large current surge would require heavier windings on the motor 13, which increases its cost and decreases the efficiency of the cryogenic refrigerator.

Additionally, when the motor 13 is turned off, there exists a substantial temperature differential between the cold head 45 and the relatively warm cooling fins 37. This temperature differential can cause the refrigerator to operate spontaneously in reverse as a modified Stirling cycle engine, which would result in a rapid warming of the cold head 45. Particularly in applications where the refrigerator 11 is operated intermittently, this effect can severely degrade the efficiency of the refrigerator.

In order to overcome these problems a bypass channel 49 and an unloader valve 51 are provided to bypass the compressor piston 15 for a short time each time the motor 13 is started or turned off. The bypassing of the compressor piston 15 by the channel 49 and valve 51 allows the working gas to escape from the compression cylinder 33 during the initial compression strokes of the piston 15. Thus the differential pressure build up in the compressor cylinder 37 is substantially reduced so that the starting torque on the motor 13 is minimized. Consequently the initial current surge in the motor 13 is also minimized. Similarly, when the motor is turned off, the opening of the valve 51 reduces the compression in the compressor cylinder 33 which prevents the refrigerator 11 from running in reverse as an engine.

Figure 2:
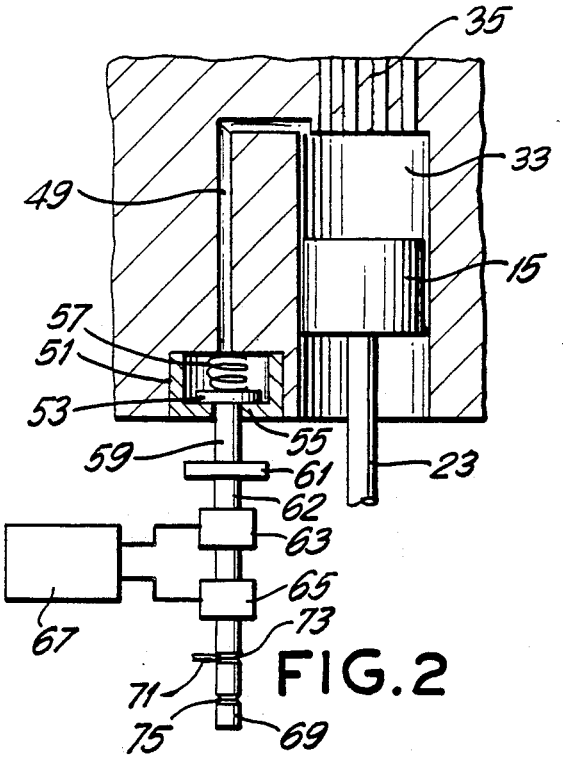
FIG. 2 is a sectional view of the improved unloader valve mechanism of the cryogenic refrigerator in accordance with the invention.

Referring now to FIG. 2 of the drawings, the valve mechanism 51 in accordance with the invention is illustrated in greater detail. The valve comprises a valve disk 53 which is integral with a valve stem 59. The valve disk 53 is biased by the bias spring 57 toward the normally closed position in contact with the valve seat 55 thereby blocking the channel 49. The valve is opened and closed by the valve actuator 61 by the action of the solenoids 63 and 65. The solenoids 63 and 65 are in turn controlled by the control circuit 67. Stem 62 of the valve actuator 61 extends through the solenoid 63 and 65. The stem 62 should be made of a non-magnetic material such as stainless steel. The solenoid plungers (not shown) can be formed of collars of magnetic material positioned on the stem 62 for being actuated by the solenoids 63 and 65.

When the motor 13 (FIG. 1) is turned on, the control circuit 67 transmits a pulse to the solenoid 63 which causes the valve actuator 61 to move upwardly against the valve stem 59 thereby causing the valve disk 53 to open against bias and bypassing the compressor cylinder 33 through the bypass channel 49.

The lower end 69 of the actuator stem 61 is engaged by a detent member 71. When the valve actuator 61 is in the lower position with the valve 51 closed, the detent member 71 engages the lower portion 69 of the valve stem 62 at the circumferential groove 73. When the solenoid 63 is energized, the actuator 61 moves upwardly to open the valve 51 so that the detent 71 engages the lower groove 75 of the stem 62 in order to retain the valve disk 53 in the open position.

After the starting surge of the electrical motor 13 has passed, the control circuit 67 transmits an electrical pulse to the solenoid 65 to move the valve actuator 61 back to the position shown in FIG. 2 which returns the valve disk 53 to its normally closed position. In the closed position the valve disk 53 blocks the bypass channel 49 in order to permit the refrigerator 11 to operate normally. Opening the valve 51 for about 8 to 12 seconds when the motor is turned on is generally adequate to allow the starting surge to pass, depending on the characteristics ®of the motor 13.

Similarly, when the motor 13 is turned off, the control circuit 67 transmits a pulse to the solenoid 63 to raise the valve actuator 61 which opens the valve 51 and bypasses the compressor cylinder 33 again. The bypassing of the cylinder 33 prevents the temperature difference between the cold head and the upper portion of the valve body 31 from causing the refrigerator pistons to run spontaneously in reverse as an engine. Generally it is necessary to maintain the valve 51 in the open position for only a short time, on the order of five seconds, at turn off to prevent the system from running in reverse. At the end of that period the solenoid 65 can be energized to cause the valve actuator 61 to move downwardly in order to close the valve 51. If desired, it is also possible to leave the valve in the open position while the motor 13 is turned off and to cause the circuit 67 to transmit a pulse to the solenoid 65 only after the starting surge has passed the next time the electrical motor 13 is turned on. The valve 51 need be kept open during start up of the motor 13 only long enough to permit the starting surge to pass.

The cross-sectional area of channel 49 need be only large enough to reduce the compression in the cylinder 33 sufficiently to reduce the starting torque on the motor 33 at turn-on and to prevent the reverse operation of the refrigerator 11 at turn-off. The cross-sectional area should not be too large since it acts as dead volume and would reduce the efficiency of operation of the refrigerator 11. The optimum diameter of the channel 49 is dependent on the volume of the compressor cylinder 33. It has been found that for cryogenic refrigerators capable of delivering of about 15 watts of cooling to the cold head 45 at 77, a channel diameter of about 0.050 inches is preferred.

Figure 3:
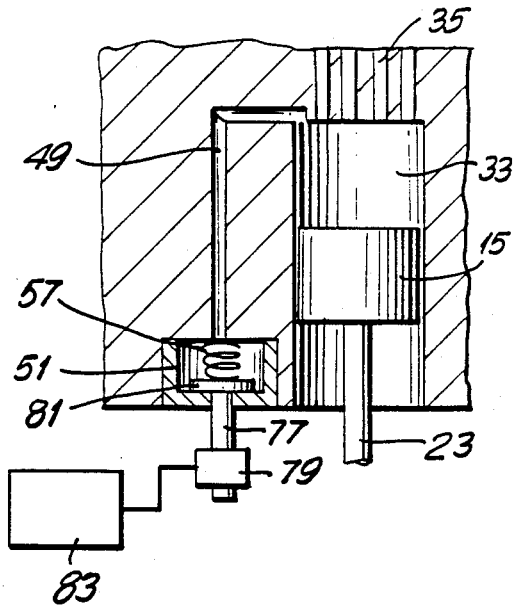
FIG. 3 is a sectional view of an alternative embodiment of the improved unloader valve of the cryogenic refrigerator of the invention.

An alternative embodiment of the invention is illustrated in FIG. 3 of the drawings. In this embodiment the valve stem 77 is itself attached to the plunger for the solenoid 79. The valve disk 81 is normally held closed by the bias spring 57. The control circuit 83 transmits a pulse of the appropriate duration to the solenoid 79 to raise the valve stem 77 to open the valve 51 for a short time each time the electrical motor 13 is turned on or off. As in the case of the embodiment of FIG. 2, the valve 51 should be maintained open long enough to permit the starting surge of the motor 13 to pass when the motor is turned on and to prevent the spontaneous reverse operation of the refrigerator 11 when the motor 13 is turned off.

The mechanism of the present invention is particularly advantageous in that the valve 51 is passively maintained in the closed position during normal operation of the refrigerator 11 by the bias spring 57. Thus the solenoids of the valve actuator of the present invention need be energized only briefly each time the motor 13 is turned on or off thereby minimizing the power consumed and heat generated by the solenoids.

Larger capacity refrigerators in accordance with the invention are frequently configured with a plurality of pairs of compressor and expander cylinders driven by the same motor and attached to a single cold head. In such embodiments it is advantageously possible to control the activation of a plurality of unloader valve with a single actuator and control circuit.

Figure 4:
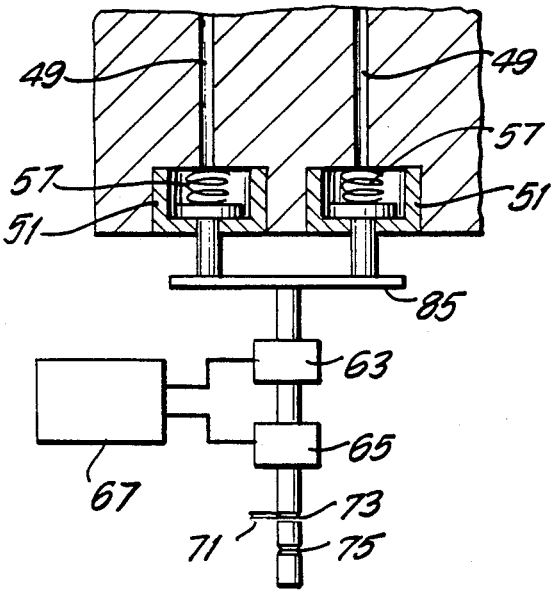
FIG. 4 is a sectional view of a portion of a dual unloader valve in accordance with the invention

In FIG. 4 of the drawings there is illustrated portion of a refrigerator in accordance with the invention in which a single actuator 85 operates two unloader valves 51 each of which is arranged to bypass a different compressor piston. Additional unloader valves can be added to control the bypassing of additional compressor pistons, depending on the design of the refrigerator.

Although the valve 51 has been shown as being retained in the closed position by the bias spring 57, it should be apparent that other passive valve biasing or latching mechanisms could be used as well to accomplish the result. While the illustrated embodiment is preferred because of its simplicity and low cost, the claims are not limited to the particular embodiment illustrated.

I claim:

1. A closed cycle modified Stirling cycle refrigerator having a first piston for compressing a working gas in a cylinder and a second piston for expanding the compressed gas, comprising:

powered means for driving said pistons;

channel means communicating with said cylinder on either side of said first piston for bypassing said first piston in said cylinder;

a valve for blocking said channel means when closed;

means for closing said valve and for passively retaining said valve in the closed position; and control means operable when said powered means is turned off for opening said valve for a time sufficient to prevent said pistons from being driven spontaneously in reverse.

2. The modified Stirling cycle refrigerator of claim 1 wherein said powered means includes an electrical motor coupled in a driving relationship to said pistons and wherein said control means further includes means for opening said valve when said electrical motor is turned on to unblock said bypass channel means for a period sufficient to minimize the starting surge in said motor.

3. The modified Stirling cycle refrigerator of claim 1 wherein said valve closing and retaining means including resilient means for biasing said valve toward the closed position.

4. The modified Stirling cycle refrigerator of claim 3 wherein said control means includes solenoid means for opening said valve against bias when said solenoid means is energized.

5. The modified Stirling cycle refrigerator of claim 1 wherein said valve closing and retaining means includes first solenoid means for closing said valve when activated and first detent means for preventing the unintentional opening of said valve while said valve is in the closed position.

6. The modified Stirling cycle refrigerator of claim 5 wherein said valve closing and retaining means includes means for biasing said valve towards the closed position and wherein said control means for opening said valve includes second solenoid means operable for moving said valve against bias to the open position.

7. The modified Stirling cycle refrigerator of claim 6 wherein said control means further includes second detent means for holding said valve in the open position when said valve is moved to said open position by said second solenoid means.

8. A closed cycle modified Stirling cycle refrigerator having a compressor piston for compressing a working gas in a compression cylinder, comprising:

electrical motor means for cyclically driving said compressor piston;

channel means communication with said compressor cylinder on either side of said compressor piston for bypassing said compressor piston for reducing the build-up of pressure in said compressor cylinder during the compression stroke of said piston;

valve means for blocking said channel means when in a closed position to permit normal operation of the refrigerator, said valve means including passive means for retaining said valve means in the closed position; and control means operable each time said motor means is turned on or off for opening said valve means against the action of said passive means for a period sufficient to minimize the starting torque in said motor means when said motor means is turned on and for preventing the refrigerator from running spontaneously in reverse when said motor means is turned off.

9. A closed cycle modified Stirling cycle refrigerator comprising:

a plurality of pairs of pistons, one piston of each pair being a compressor piston, each for compressing a working gas in a corresponding cylinder;

electrical motor means for driving of said pistons;

separate channel means each communicating with a corresponding one of said cylinders on either side of the corresponding compressor piston for bypassing such corresponding compressor piston;

valve means for each of said channel means for blocking the corresponding channel means when in the closed position to permit normal operation of the refrigerator, each said valve means including passive means for retaining said valve means in the closed position; and common control means operable each time said motor means is turned on or off for opening all of said valve means against the action of said passive means for a period sufficient to minimize the starting torque in said motor means when the motor means is turned on and for preventing the refrigerator from running spontaneously in reverse when said motor means is turned off.

* * * * *